US005206961A

United States Patent [19]

Rüegg

[11] Patent Number: 5,206,961

[45] Date of Patent: May 4, 1993

[54] WALL-MOUNTED URINAL

[75] Inventor: Urs Rüegg, Jona, Switzerland

[73] Assignee: Geberit AG, Jona, Switzerland

[21] Appl. No.: 731,495

[22] Filed: Jul. 17, 1991

[30] Foreign Application Priority Data

Jul. 20, 1990 [CH] Switzerland ..... 2420/90

[51] Int. Cl.[5] ..... E03D 11/14; E03D 11/12

[52] U.S. Cl. ..... 4/252.3; 4/307; 248/284

[58] Field of Search ..... 4/301, 307, 310, 311, 4/312, 252.1, 252.2, 252.3, DIG. 2; 285/64; 248/284, 291, 293

[56] References Cited

U.S. PATENT DOCUMENTS

| | | | |
|---|---|---|---|
| 1,040,823 | 10/1912 | Watrous | 285/64 X |
| 2,076,950 | 4/1937 | Koch | 4/312 |
| 2,678,450 | 5/1954 | Simpson et al. | 4/252.3 X |
| 3,490,727 | 1/1970 | Miller | 248/284 |
| 3,667,714 | 6/1972 | Ziaylek, Jr. | 248/284 |
| 3,742,522 | 7/1973 | Stevenson | 4/311 X |
| 4,233,693 | 11/1980 | Stocklöw | 4/653 X |
| 4,441,218 | 4/1984 | Trybom | 4/252.2 |
| 4,982,455 | 1/1991 | Carter | 4/307 |
| 5,014,953 | 5/1991 | Warnan et al. | 248/284 |

FOREIGN PATENT DOCUMENTS

| | | | |
|---|---|---|---|
| 8800993 | 2/1988 | European Pat. Off. | 4/312 |
| 0467828 | 1/1992 | European Pat. Off. | 4/301 |
| 2839242 | 3/1980 | Fed. Rep. of Germany | 4/310 |
| 1502879 | 11/1967 | France | 4/312 |
| 2434242 | 4/1980 | France | 4/307 |

*Primary Examiner*—William A. Cuchlinski, Jr.
*Assistant Examiner*—John L. Beres
*Attorney, Agent, or Firm*—McGlew and Tuttle

[57] ABSTRACT

To simplify the installation and maintenance of a urinal, the bowl (3) is fastened to the building wall (6) such that it can be turned away from it. To achieve this, a bracket (8) is provided, which has a holding frame (10) fastened to the bowl (3), a mounting plate (9) fastened to the wall (6), as well as support rods (11) hinged to these. For maintenance, the bowl (3) is detached from bolts (7) and is swung away from the building wall by the holder (8) in a forward and downward direction. The fittings (26, 27, 19) and devices (5) arranged behind the bowl (3) are accessible from the side, from the bottom, and from the top. After maintenance, the bowl (3) is turned back to the building wall (6), and is fastened with the bolt (7).

8 Claims, 1 Drawing Sheet

WALL-MOUNTED URINAL

FIELD OF THE INVENTION

The present invention relates to a wall-mounted urinal and more particularly to a wall-mounted urinal with a bowl having a flushing insert and a drain and with connections arranged behind the bowl and with a device for controlling flushing.

BACKGROUND OF THE INVENTION

A urinal of this class, which has a bowl upper part to be fastened on a building wall, as well as a bowl lower part detachably fastened to this upper part, has become known in the art from EP-A-0,313,734. The bowl lower part is fastened to the bowl upper part after fastening the bowl upper part and after installing the water connection and the drain and serves as a cover for the parts belonging to the water connection and to the drain. A solenoid valve and a control device, which are accessible for maintenance on the side and from the bottom after removal of the bowl lower part, are arranged behind the bowl upper part.

A two-part design of a urinal bowl limits the freedom of design, which is extremely important in the case of sanitary devices for adjustment to different styles. As was mentioned, the bowl lower part must be removed and placed on the side for maintenance of the devices arranged behind the bowl. Since a bowl lower part made from sanitary ceramic is relatively heavy, fragile, and bulky, any maintenance work is made difficult by the need to remove and then replace the bowl lower part. The joints and shadow-producing joints between the two bowl parts are disadvantageous for hygienic and aesthetic reasons.

SUMMARY AND OBJECTS OF THE INVENTION

It is an object of the present invention to design a urinal of the above-described class which optimally meets the requirement in terms of simple installation and maintenance, and the requirement for the highest possible hygiene and safety against vandalism.

According to the invention, a wall-mounted urinal is provided comprising a bowl having a flushing insert and a drain and with connections arranged behind the bowl and with a device for controlling the flushing. Support means for allowing the bowl to be swung or moved away from a building wall for maintenance is provided wherein the bowl may be swung away from an installation wall by a limited amount after loosening a fastening device. This support means is preferably provided in the form of a bracket with a mounting plate fastened to the building wall, a holding frame inserted into the bowl and at least one support hinged to the mounting plate and with the holding plate arranged behind the bowl. The holding frame is preferably fitted into a circumferential edge of the bowl. The support means preferably also includes two brackets which are arranged at spaced locations from one another and which project from the building wall. The brackets are provided for supporting the pivotable bracket. The pivotable brackets preferably consist of two pairs or parallel bars which may be pivoted vertically and perpendicularly to the building wall such that a rear side of the bowl extends approximately in parallel to the outside of the building wall after being swung out by a limited amount. The mounting wall is preferably provided with a wall box inserted into the building wall wherein the mounting plate is fastened to the wall box. The drain of the urinal preferably is connected to a siphoned trap attached to a pipe section which may be pushed into an opening of the drain line arranged in the building wall. This pipe section may be separated from the drain line when the bowl is swung out. The urinal preferably swings out in a downward direction to a position spaced from the wall, thereby facilitating maintenance.

In the urinal according to the present invention, the bowl can be turned away from the building wall by a limited amount for installation and maintenance after loosening a fastening device. Thus, the bowl of the urinal according to the present invention can be made in one piece and can have nearly any desired outer shape. After turning the bowl out of the way, it remains fully connected to the wall, so that no individual parts will lie around during maintenance.

According to an advantageous variant of the present invention, a mounting plate, which is connected in a hinged manner to a holding frame inserted into the bowl on the rear side by means of supports, is fastened to the building wall. This ensures a connection that is stable and yet of a simple design between the bowl and the building wall. A particularly stable connection between the holding frame and the bowl is ensured if the holding frame is fitted to a circumferential edge of the bowl. The control device of the urinal can be arranged within this holding frame, and is additionally protected by it. The technical devices of the urinal can thus be fully covered in a tamper-proof manner. Accessibility to the devices arranged behind the bowl is particularly advantageous if the bowl can be turned away from the building wall such that in the turned-out state, the rear side of the bowl extends in parallel to the outside of the building wall. The above-mentioned devices are now accessible on all sides and especially from the top. Accessibility from the top facilitates and improves the maintenance because the intermediate space between the bowl and the wall is better illuminated.

The accessibility to the devices on which maintenance work is to be performed is further improved if, according to a variant of the present invention, the bowl can be turned away from the building wall in the downward direction.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings.

One embodiment of the present invention will be explained below in greater detail on the basis of the drawings in which.

DETAILED DESCRIPTION OF THE PREFERRED EMBODIMENT

Figure 1:
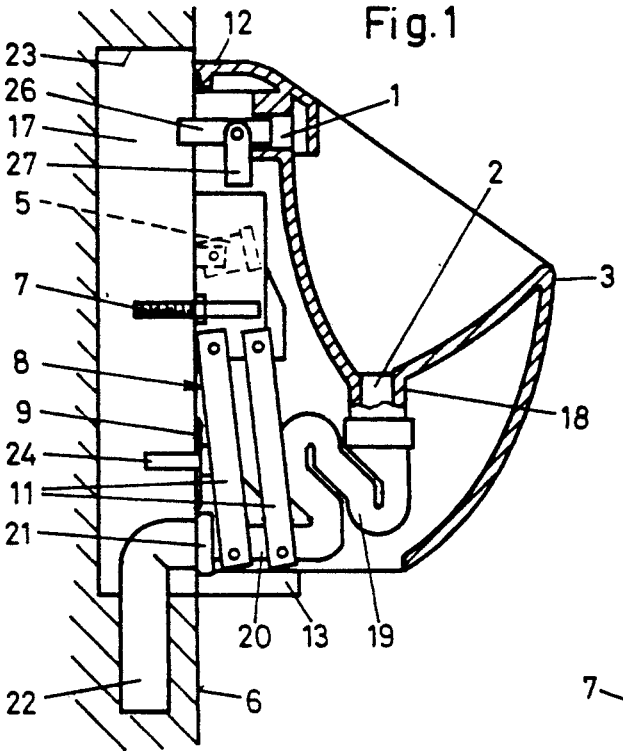
FIG. 1 is a vertical sectional view taken through an installed urinal according to the present invention in the ready-to-use state.
Figure 3:
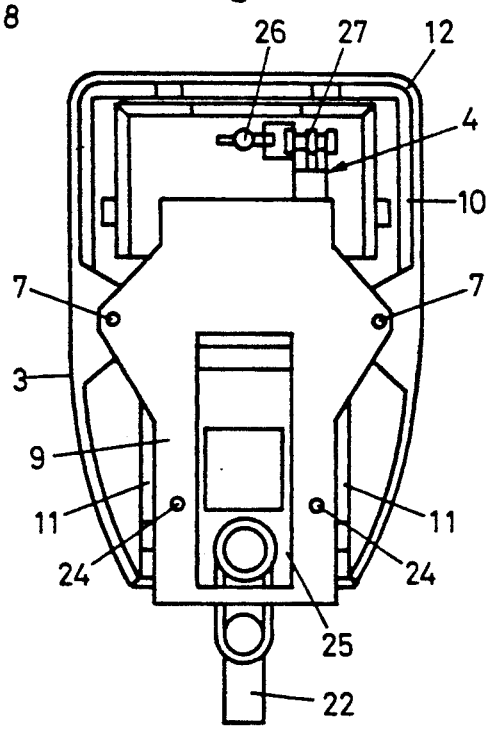
FIG. 3 is a rear view of a mounting plate with the bowl fastened to it.

Referring to the drawings in particular, the urinal according to the invention has a bowl 3 which has a covered flushing water insert 1 in its upper part for delivering flushing water to the bowl 3 and an outlet 2 in its lower zone. The outlet 2 leads via a pipe socket 18 to a siphon trap 19, and from here to a drain line 22 arranged in the building wall 6 via a horizontally extending pipe section 20. As is shown in FIG. 1, the front end of the pipe section 20 is removably pushed into the opening 21 of the drain line 22. A leathering (not shown) seals the pipe section 20 against the drain line 22.

A known wall frame 17, on which the bowl 3 is fastened to the building wall 6 by means of threaded bolts 7, is inserted into a niche 23 of the building wall 6.

A mounting plate 9 is also fastened to the wall frame 17 by means of the bolt 7 and additional bolts 24. A radar antenna 5 of an integrated presence control device, as well as a water feed pipe 26 with a solenoid valve 27 for controlling the water feed, are arranged on the outside of the mounting plate 9. If the bowl 3 is detached from the threaded bolts 7, it can be turned away into the position shown in FIG. 2 by means of a bracket 8. During this movement, the bowl 3 is first moved away from the wall horizontally over a short distance, and the pipe section 20 is separated from the drain line 22 and the water feed pipe 26 is separated from the inlet 1. The bowl 3 is subsequently moved in the forward and downward direction until it reaches the stable rotated position shown in FIG. 2.

Figure 2:
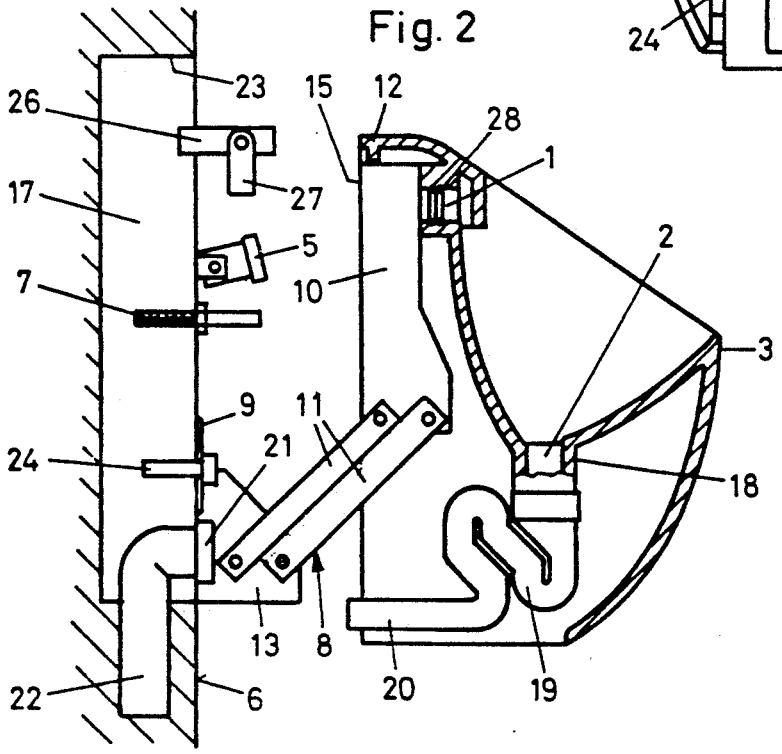
FIG. 2 is a sectional view similar to that in FIG. 1, in which the bowl is turned away from the building wall by a limited amount for maintenance.

The bracket 8 has two pairs of parallel support rods 11, which are pivotably connected to brackets 13 of the mounting plate 9 and are also hinged to a holding frame 10 firmly screwed to the bowl 3. In the state in which the bowl is not turned away, the holding device 8 as well as the mounting plate 9 are fully covered by the edge 12 of the bowl 3 at the top and on the sides. If, in contrast, the bowl 3 is turned away from the wall 6, as shown in FIG. 2, the mounting plate 9 with the water supply and water drain fittings 26, 27, as well as 19–22 and the electronic control unit are accessible from the bottom, from the side, and from the top. In the turned-out position, the horizontal distance between the rear side 15 of the bowl 3 and the outside 16 of the wall is, e.g., 15 cm. Despite this relatively great distance and the good stability of the bracket 8, relatively little space is required for it on the rear side of the bowl 3. The bowl 3 can thus be designed to be relatively narrow and of small depth.

After maintenance has been performed on the devices and fittings located behind the bowl 3, the bowl 3 is again turned against the building wall 6, and fastened with the bolts 7 in the known manner. On turning back, the free end of the pipe section 20 is pushed into the opening 21 of the drain line 22, and the water feed pipe 4 is at the same time pushed into a leathering 28 of the flushing insert 1. After fastening the bowl 3 on the building wall 6, the fittings and devices of the urinal are covered by the bowl 3 and the frame 10, and are optimally protected in a tamper-proof manner.

While a specific embodiment of the invention has been shown and described in detail to illustrate the application of the principles of the invention, it will be understood that the invention may be embodied otherwise without departing from such principles.

What is claimed is:

1. A wall-mounted urinal, comprising: a bowl element having a flushing water insert and a drain and with connections arranged behind the bowl element and with a device for controlling flushing; support means connected to a mounting wall and connected to the urinal for swinging the urinal away from the mounting wall by a limited amount after loosening a fastening device connecting said urinal to said mounting wall, said support means includes a mounting plate fastened to the mounting wall and a holding frame connected to said bowl element and at least one support member hinged to said mounting plate and connected to said holding frame, said holding frame being positioned behind said bowl.

2. The wall-mounted urinal according to claim 1, wherein said holding frame is fitted into a circumferential edge of said bowl element.

3. The wall-mounted urinal according to claim 1, wherein said plate includes two brackets arranged at spaced locations from one another projecting from said mounting wall, said support element being pivotably connected to one of said two brackets and another support element being pivotably connected to another said two brackets.

4. The wall-mounted urinal according to claim 1, wherein said support element comprises two pairs of parallel bars pivotable vertically and perpendicularly with respect to the mounting wall, said bowl having a rear side extending approximately in parallel to a side of said mounting wall after being swung out by a limited amount supported by said pairs of parallel bars.

5. The wall-mounted urinal according to claim 1, wherein said mounting plate is fastened to a wall box inserted into said mounting wall.

6. The wall-mounted urinal according to claim 1, wherein said mounting plate is connected to said mounting wall by threaded bolts projecting at right angles from said mounting wall, said bolts being connected to said mounting plate for fastening said bowl.

7. The wall-mounted urinal according to claim 1, wherein said support means allows said bowl element to be swung away from said building wall in a downward direction.

8. A wall-mounted urinal, comprising:

a bowl element having a flushing water insert, a drain connections arranged behind the bowl element, and with a device for controlling flushing;

support means connected to a mounting wall and connected to the urinal for swinging the urinal away from the mounting wall by a limited amount after loosening a fastening device connecting said urinal to said mounting wall; and a siphon trap connected to said drain of said bowl element, said siphon trap being further connected to a pipe section which may be pushed into an opening of a drain line extending into said mounting wall, said pipe being separable from said drain line when said bowl element is swung out away from said mounting wall.

* * * * *